US009457952B2

(12) United States Patent
Heatley

(10) Patent No.: US 9,457,952 B2
(45) Date of Patent: Oct. 4, 2016

(54) LIQUID SPRAY SYSTEM

(71) Applicant: SEYMOUR OF SYCAMORE, INC., Sycamore, IL (US)

(72) Inventor: Christopher Heatley, McHenry, IL (US)

(73) Assignee: SEYMOUR OF SYCAMORE, INC., Sycamore, IL (US)

( * ) Notice: Subject to any disclaimer, the term of this patent is extended or adjusted under 35 U.S.C. 154(b) by 0 days.

(21) Appl. No.: 14/618,306

(22) Filed: Feb. 10, 2015

(65) Prior Publication Data

US 2015/0158661 A1 Jun. 11, 2015

Related U.S. Application Data

(63) Continuation of application No. 13/754,670, filed on Jan. 30, 2013, now Pat. No. 8,978,935.

(51) Int. Cl.

| | |
|---|---|
| ***B65D 83/42*** | (2006.01) |
| ***B65B 31/00*** | (2006.01) |
| ***B65D 83/32*** | (2006.01) |
| ***B65D 83/38*** | (2006.01) |

(52) U.S. Cl.

CPC ..... *B65D 83/425* (2013.01); *B65D 83/32* (2013.01); *B65D 83/38* (2013.01); *B65D 83/384* (2013.01); *B65D 83/42* (2013.01); *B65B 31/00* (2013.01); *B65B 31/003* (2013.01)

(58) Field of Classification Search

CPC .. B65D 83/425; B65D 83/38; B65D 83/384; B65D 83/42; B65D 83/32; B65D 31/00; B65D 1/003

USPC ..... 222/1, 94–95, 105, 183, 394, 399, 222/402.1, 402.16, 386.5; 141/3, 10, 18, 141/20, 113, 21, 27

See application file for complete search history.

(56) References Cited

U.S. PATENT DOCUMENTS

| | | | | |
|---|---|---|---|---|
| 2,351,376 | A * | 6/1944 | Ward | 222/399 |
| 2,841,190 | A * | 7/1958 | Scheck | 141/20 |
| 3,273,606 | A * | 9/1966 | O'Neill | 141/3 |
| 3,343,718 | A * | 9/1967 | Siegel et al. | 222/1 |
| 3,477,195 | A * | 11/1969 | Chambers | 53/470 |
| 3,556,171 | A * | 1/1971 | Gangwisch et al. | 141/3 |
| 4,174,811 | A * | 11/1979 | Binder et al. | 239/308 |
| 4,988,017 | A * | 1/1991 | Schrader et al. | 222/130 |
| 5,179,982 | A * | 1/1993 | Berube et al. | 141/20 |
| 5,431,303 | A * | 7/1995 | Miskell | 222/54 |
| 6,196,275 | B1 * | 3/2001 | Yazawa et al. | 141/3 |

(Continued)

FOREIGN PATENT DOCUMENTS

| | | | | |
|---|---|---|---|---|
| EP | 2107012 | A1 * | 10/2009 | B65D 83/14 |
| WO | WO 9323313 | A1 * | 11/1993 | B65D 83/14 |
| WO | WO 2012081754 | A1 * | 6/2012 | B65D 83/14 |

*Primary Examiner* — Frederick C Nicolas

(74) *Attorney, Agent, or Firm* — McDonnell & Boehnen Hulbert & Berghoff LLP

(57) ABSTRACT

A spray system for dispensing a homogenous mixture of a liquid formulation and propellant as an atomized aerosol where a disposable container containing a liquid base is used alone or secured within a rigid container and is charged through a fitting in fluid communication with the interior of the disposable container using a detachable pressurized charge can containing a propellant compatible with the liquid base. Preferably the liquid formulation is a paint base that can be tinted at the point of sale before charging with the charge can.

1 Claim, 4 Drawing Sheets

(56) References Cited

U.S. PATENT DOCUMENTS 6,435,231 B1 * 8/2002 Cooper et al. ..... 141/346
6,698,620 B2 * 3/2004 Ogata et al. ..... 222/95
7,201,191 B2 * 4/2007 Heatley et al. ..... 141/9
8,978,935 B2 * 3/2015 Heatley ..... B65D 83/32 141/18

* cited by examiner

LIQUID SPRAY SYSTEM

CROSS REFERENCE TO RELATED APPLICATIONS

The present application is a continuation of U.S. patent application Ser. No. 13/754,670, filed Jan. 30, 2013 which is herewith incorporated by reference into the present application.

FIELD OF THE INVENTION

My invention relates to a system that allows for the preparation of a pressurized aerosol container of liquid, specifically a liquid paint formulation of a desired color and gloss, at the point of retail sale to the ultimate end user. Specifically, my invention relates to a system for custom blending a final liquid formulation and charged with an appropriate propellant such that the final pressurized system can then be used to spray the atomized liquid formulation directly on a substrate.

BACKGROUND

One of the most significant developments in the field of liquid applications, including paints and other protective coatings, is the introduction and development of aerosolized coatings, most commonly referred to as an "aerosol can" or "spray paint." Retail stores have shelf upon shelf of these pre-filled pressurized containers filled with all sorts of liquids, from bug spray to sun screen formulations. In particular, a significant amount of shelf space is devoted to numerous complete paint and coatings formulations, in every imaginable color and gloss that are "ready to use." These complete, pre-packaged spray paint containers provide the customer with a convenient means to purchase moderate quantities of paint in a readily useable spray container for easy application. Unfortunately, in situations where the end user only wants a small quantity of liquid or perhaps a custom blend of liquid ingredients or has a particular color in mind or wants to match a particular existing color, the current art of aerosols or spray paint forces the end user to accept only what is available or to select a paint color that in most cases is not the exact color that the user desires. This is because there is no convenient means to allow a consumer to prepare a custom liquid formulation for spraying or to select an exact match of color at the point of aerosol purchase. Instead, in the case of paint applications, the user must search a myriad of brands of spray paint in the hope of finding a color that at least comes close to the desired color. Often times, this causes the end user to travel from store to store in search of such a match. Another drawback of the conventional spray paint product is that the inability to prepare a final paint color at the point of sale directly affects the retailer. Because conventional spray paint is only available from the manufacturer in pre-selected and predetermined colors and gloss, the retailer is forced to stock and carry inventory for a large number of cans to accommodate a large number of colors and gloss finishes. This further requires the use of an inordinate amount of shelf space in the store, thus limiting the amount of other products that can be displayed.

A convenient solution to the above-mentioned problems would be to allow the retail outlet at the point of sale to prepare custom liquid formulations while the customer waits or to formulate a final color of an aerosol spray paint based on the end user's selections of color and gloss at the moment of sale. In this way, only a very limited number of containers with base liquids or containers with either a clear or neutral base paint formulation need to be stocked and shelved by the retailer. The end user can then have a custom blend a particular liquid formulation prepared or in the case of paint, select a final paint formulation that exactly matches his or her needs. My earlier U.S. Pat. Nos. 7,201,191 and 7,252,119 do provide one possible solution to the above-mentioned problems. However, there exists the problem, once the final liquid formulation is chosen and added to a container, of injecting or adding an appropriate propellant that is needed to create an atomized spray of the liquid for application to a substrate.

My invention now provides a new and improved liquid spray system that includes a disposable charge can that adds propellant and other compounds to a base liquid contained in a disposable container fabricated of low cost materials, such as, plastic, tin, or aluminum.

SUMMARY

My invention includes systems and methods for preparing such systems for spraying/atomizing liquid formations, specifically paint formulations and the like materials. Preferably, these systems are used by an employee of a retail store at a point of sale location to prepare a pressurized custom spray formulation for a purchasing consumer that can be immediately used by the customer to apply the formulation to a substrate. The spray system of my invention can take on a number of different configurations. Common attributes of each of the different configurations of my invention include, in combination, a disposable low cost container with or without an outer rigid outer container that accepts the disposable container, and a valve assembly configured to be inserted into the disposable container, a sealing cap to secure the valve assembly, and a pressurized charge container that is designed to temporarily attach to the valve assembly or through a fitting in the bottom of the disposable container in order to pressurize the disposable container. In one particular system there is a reusable a disposable container fabricated of low cost material, such as plastic, tin, aluminum or other like materials, having an upper end and an interior cavity with a volume for holding a liquid formulation. An important aspect of my invention is that the disposable container must be constructed and configured to withstand internal pressurization of at least about 80 psig. A sealing cap, preferably constructed of plastic, can be removably fastened to the upper end of the disposable container, where the fastener or connection is configured to seal the valve assembly within the container to maintain pressure within the disposable container. The system can also include a rigid container, having an open upper end that can accept the disposable container within the rigid container to provide support, strength and safety when the interior cavity of the disposable container is pressurized by the external charge can. A rigid cap, configured for removable connection to the upper end of the rigid container, sealably encloses the disposable container within the rigid container such that the disposable container can be pressurized without rupturing or losing pressure. A valve assembly comprising a fitting, a flange and a dip tube fits within an opening in the top end of the disposable container. The valve assembly is held in a sealing connection with the upper end of the disposable container through the use of the sealing cap. Once in place the sealing cap and valve assembly form a pressure seal when the sealing cap is fixed to the upper end of the disposable container. In the embodiment where a rigid container is used to hold the disposable container a rigid cap is fixed to the upper end of the rigid container and this configuration forms a pressure seal with the valve assembly and the disposable container. The rigid container is configured and constructed of durable materials so that is can be reused with new disposable containers. The can also include a disposable cap that covers and protects the upper end of the disposable container and is configured to be removed and thrown away prior to inserting the valve assembly and attaching the sealing cap.

The invention also includes a charge can that has an outlet fitting that mates with a corresponding inlet fitting located either on the valve assembly when the rigid container is included or on the bottom of the disposable container when no rigid container is used. The inlet and outlet fittings may be configured as proprietary fittings meaning that that fitting are not of a common or standard design, similar to a key and lock. In other words, the male portion of the fitting will only fit into a like configured female fitting. This can be accomplished a number of ways including non-standard thread design, non-standard luer-lok, non-standard quick disconnects, and non-standard releasable snap locks to name a few. Using proprietary fittings prevents attachment of non-approved pressure sources and thus prevents accidental over pressurization. The charge can is used to pressurize and transfer a propellant to the disposable container either alone or when it is secured within the rigid container. The charge can may also transfer other ingredients to the interior volume of the disposable container.

In a preferred embodiment, the disposable container contains a paint base in the cavity selected from the group consisting of a solvent base, a waterborne base and a latex base. A tint and/or pigment dispersion can be added to the paint base to achieve a final desired color. In addition to the pressurized gas and propellant, the charge can may also contain a paint catalyst that accelerates the drying of the paint or otherwise improves the paint formulation. In the case of epoxies, the catalyst initiates the chemical reaction that hardens the epoxy formulation. A coupler can be used to connect the charge can fitting to the fitting on the valve assembly to provide a fluid connection between the charge can and the interior volume of the plastic container. After charging is complete, the charge can is removed and can be disposed of or reused depending on the original ingredients in the charge can. The charge can is preferably designed and configured for a single use and then is either disposed of or reprocessed, i.e., recycled and/or refilled with a pressurized propellant and/or catalyst. A spray head is attached to the fitting on the valve assembly and the pressured container is ready for use. One unique aspect to my invention is that the charge can is designed and configured to be charged at a pressure greater than 80 psi, preferably greater than 100 psi so that when it is connected to the interior volume of the disposable container, a complete transfer of all the propellant, other ingredients and/or catalyst is effected and the disposable container is pressurized to at least 80 psig or greater. Further, pressurization using the charge can is performed as a single step and the charge can is removed from the system and not used again.

Although my invention is described herein as preparing pressurized spray paint containers at the point of retail sale for use by a purchasing customer, my system can be used to prepare any pressurized spray container containing liquids other than paint, for example, air fresheners, cleaners, polishes, insecticides, adhesives, epoxies, lacquers, repellants, lubricants, sun screens, and like pressurized spray products sold to consumers at retail stores. For clarity and ease of understanding the following description will relate to preparing a "spray paint" container.

In one possible use of my invention, a customer selects his desired end product color from a color chart or by matching an existing color from a sample. Next, the retail store employee determines a recipe of tints and other components to add to the disposable container that already contains a base paint formulation (i.e., one selected from the group consisting of a solvent base, a waterborne base and a latex base) such that a final paint formulation (or other liquid formation if the end product is not a spray paint product) results when dispensed as a spray from the complete system will result in a spray paint product that matches the color and gloss requested by the customer.

The connection between the fitting on the valve assembly and the charge can is preferably accomplished using an adaptor, coupler, or other fitting that ensures a fluid seal to allow transfer of the contents of the charge can into the disposable container. This adaptor/coupler can be configured to be disposable or reusable. Preferably, the coupler provides a proprietary connection to the valve assembly and charge can such that no other manufacturer's products will connect with the coupler. This prevents the retail store employee from using the wrong or improper charge can to pressurize the disposable container. Likewise, having keyed fittings prevents the employee from charging the wrong propellant into a non-compatible pre-existing liquid formulation supplied in the disposable container. To achieve this keyed connection between the fittings or the coupler, the respective fittings or connectors having matching connectors, such as grooves, slots, splines, thread pitch, bayonet fittings, or the like keyed features that work similar to a key and lock combination.

The disposable containers of my invention preferably are supplied by a manufacturer to the retail store containing a base paint formulation as a so-called "blank" containers. (i.e., pre-filled disposable containers containing an initial or base paint formulation, but without color and at atmospheric pressure). The disposable containers can be provided in sizes of 8 oz., 16 oz., and 20 oz. These blank containers can be made available by a manufacturer containing a number of different initial liquid formulations that are compatible with different propellants contained in the charge cans. In the case of preparing a finished spray paint product, the disposable container comprises an initial paint formulation comprising at least one of a clear or neutral non-pigmented base or clear or neutral pigmented base. These base paints can be water soluble, latex, or hydrocarbon solvent based.

The pre-filled disposable containers can then be shipped and stocked at a retail store utilizing only a fraction of the space needed for conventional spray paint products. Immediately prior to the sale, the ultimate end use or customer selects a final color and gloss level to complete the final paint formulation. A recipe or look up table is used by the store employee to determine the exact volumetric or weighed amounts of tints and/or pigment dispersions that are needed to be added to the disposable container through opening at the upper end of container to achieve the desired final color. These tints and/or pigment dispersions can be added individually to the interior volume of the disposable container or preferably as a single cocktail or formulation. Whether one ingredient or several ingredients are added individually or as a mix, the additives for the purposes of this disclosure are considered a liquid formulation or a paint formulation.

Typically, the final color desired is based on a matching of an existing color or type of paint previously purchased by the user. The end user will select a final color for the aerosol container by one of several methods. The user may manually reference a color wheel, paint swatches, or paint chips to select a final color and will also select or request a preferred gloss level. For each color that can be selected there will be a corresponding predetermined formula or recipe of tints and/or pigmented dispersions that when followed and the ingredients mixed with one of the three possible initial paint formulations will yield the final desired color.

Alternatively, the user may want to match an existing color based on a sample of a color that they would bring with them to the point of sale. This is performed simply by comparing the known color provided by the user to a color wheel or to paint swatches, or by using a spectrophotometer or other automated system to match colors. Typically, such an automated procedure involves providing a sample of a known color for analysis by a spectrometer whereby the exact sample color is determined and reported to either the end user or the retail store operator or directly to a computer controlled filling machine.

Once the final sample color is determined and a formula of additives is determined, the ingredients according to the formula are mixed together (or added separately) and added into the disposable container. Additionally, flattening dispersions may be added to achieve the desired gloss level, which is typically determined using gloss meter, preferably at a 60° angle. Flattening dispersions are added to modify the gloss level to the desired finish. Once all ingredients necessary to achieve the final liquid formulation are added to the disposable container, the valve assembly can be added to the upper portion of the container.

At this point in the process of preparing the paint system of my invention the valve assembly is next inserted into the disposable container through the upper end of the disposable container. The upper end preferably has a protective cap that is removed and discarded immediately before adding the final ingredients to the base formulation. This protective cap is attached at the point of manufacture of the pre-filled disposable container and provides a seal during shipment to a retail store location and during shelf life. In some cases it may be necessary or desirable to place the disposable container within the rigid container before adding the final additives to the base liquid and/or inserting the valve assembly. In any case, after the valve assembly has been inserted with the flange positioned in a sealing fashion on the opening in the upper end of the disposable container, the sealing cap is then connected, preferably via screw threads. In the embodiment of my invention where a rigid outer container is used the sealing cap also connects with the upper end of the rigid container sealing both the valve assembly to the disposable container and securely enclosing the disposable container within the rigid container. An opening in the sealing cap in this embodiment allows exposure/access to the valve assembly fitting while allowing the sealing cap to exert a downward compressive force on the flange to create a pressure seal to the orifice in the plastic cap thus insuring that the disposable container can be pressurized to at least 100 psig or more.

Once the sealing cap is in place to seal the valve assembly in the disposable container, a charge can containing a compatible propellant and pressurized gas is connected to the valve assembly fitting directly or through the use of a coupler. Once connected, the pressure in the charge can (preferably at least 100 psig or more) drives the propellant, and any other ingredients, such as a catalyst, into the interior volume of the disposable container via the fitting on the valve assembly or on the bottom of the disposable container. In the former embodiment, the fitting is in fluid communication with dip tube that is part of the valve assembly. In either configuration, the contents that were in the charge can are now intimately and homogenously mixed with the liquid formulation in the disposable container. Once the charge can contents are transferred, the charge can be disconnected. A pressure gauge connected to the charge can visually indicate to the user that contents have transferred, as evidenced by a drop in pressure. One or more check valves can be used to ensure that the contents only transfer one way, i.e., from the charge can to the disposable container.

Once the charge can is disconnected from the valve assembly fitting, a spray head can be connected to the valve assembly fitting. In the situation where a rigid outer container is not used, the valve assembly can include the spray head before the charge can is connected. The system is now ready for use in a manner that is basically the same as for well known conventional spray paint cans. Once the user is finished applying the liquid as a spray to a substrate or as an aerosol mist for order control or insect repellant, the rigid cap can be removed to allow the disposable container, with the valve assembly in place, to be removed from the rigid container and discarded. The rigid container and sealing cap can be reused with a new disposable container and new valve assembly. Reuse of the rigid container allows the retailer to place on the shelves only the pre-filled disposable containers in what could resemble expandable disposable pouches that would occupy significantly less space than a traditional rigid cylindrical container.

Advantages of my system include, but are not limited to, allowing the consumer to purchase the exact color of their choice, and not to have to accept a color that just happens to be stocked by the retailer. Consumers can also select the exact gloss desired. My system is applicable to 2K paint systems and can be used for epoxies, gel coats, acrylics, and urethanes.

Still further advantages of the present invention will become apparent upon reading and understanding the following detailed description of preferred embodiments. The invention also may take form in various parts and arrangement of parts. The accompanying drawings are only for purposes of illustrating preferred embodiments and are not to be construed as limiting the invention.

BRIEF DESCRIPTION OF THE FIGURES

The advantages and features of the present invention will become better understood with reference to the following more detailed description and claims taken in conjunction with the accompanying drawings, in which like elements are identified with like symbols, and in which:

DETAILED DESCRIPTION

Figure 1:
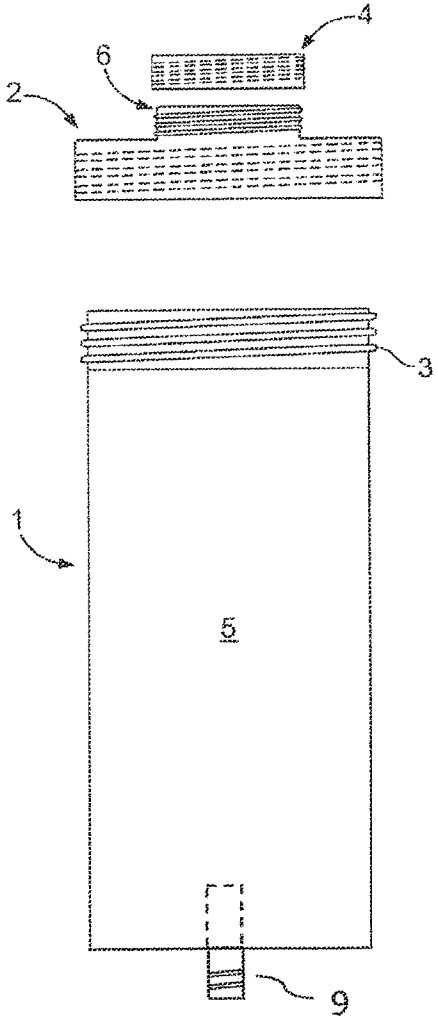
FIG. 1 is a schematic representation of one configuration of the disposable container my invention.

My spray system allows any type of homogenously mixed liquid formulation to be discharged in atomized spray pattern onto a substrate or merely into the atmosphere in the case of an air freshener or bug spray. Preferably, the liquid would be a paint mixture, either a solvent based, water based or latex based paint mixture. Turning to FIG. 1 there is shown a disposable container 1 that has an interior volume 5. This container can be comprised of any known polymer material, preferably a plastic composition that is biodegradable. Likewise, the disposable container can be fabricated from low cost materials such as tin, aluminum or like materials. Regardless of the material of construction, it is essential that the disposable container can withstand internal pressurization of about 100 psig. The volume 5 should be at least capable of holding greater than 2 oz. of liquid, most preferably greater than 5 oz. of liquid. At the upper end of disposable container 1 there is a connector, shown as screw thread 3 in the particular embodiment illustrated in FIG. 1, however, any type of connector can be used provided that it can mate with a like connector on cap 2. The connector 3 must be capable of sealing the disposable container 1 with cap 2 such that it can maintain an internal pressure in volume 5 of at least 50 psig, most preferably greater than 100 psig.

Figure 5:
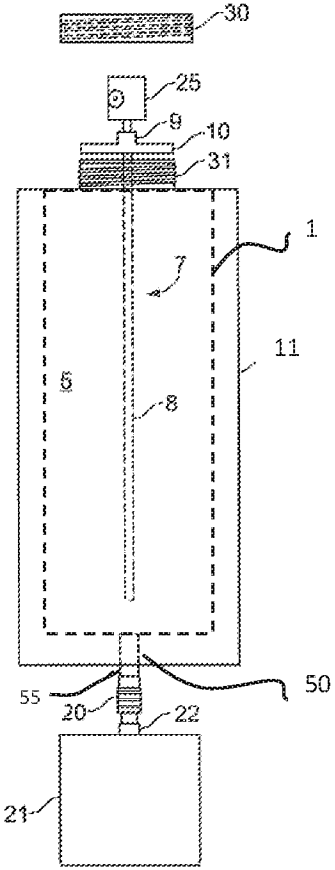
FIG. 5 is a schematic representation of an alternative embodiment of my invention where only a disposable container is used and is connected to the charge can through a coupler.

Cap 2 can be made of any material that allows it to connect and maintain a pressure seal with container 1. Preferably, cap 2 is made of the same disposable material as used to fabricate container 1. Cap 2 has an orifice 6 that is generally centered in the top of the cap and is configured to accept and/or allow attachment of a valve assembly 7 (see FIG. 2). A protective, removable small cap 4 is configured to temporarily cover and protect orifice 6 until a second valve assembly 7 including fitting 9 is ready to be installed/connected to cap 2 of container 1. The bottom of container 1 may also have a fitting 50 that provides for fluid communication with the interior cavity of container 1. The fitting 50 is configured such that when container 1 is inserted into rigid container 11 the fitting 50 extends through an orifice in the bottom of the rigid container allowing fitting 50 to be accessed by a first valve assembly 55 for attachment of a pressure source, such as the charge can 21 as illustrated in FIG. 5.

Container 1 can contain any liquid that can be sprayed/atomized. Preferably, the container is pre-filled at a manufacturing location with a paint base selected from the group comprising a water soluble, solvent based, or latex paint base. The container could also be filled at the point of sale by a retailer after selection of the liquid by the consumer. In the case of a paint base, the addition of tints or other coloring or paint enhancement compounds could be added to the paint base before final assembly and pressurization of the spray system of my invention.

Figure 2:
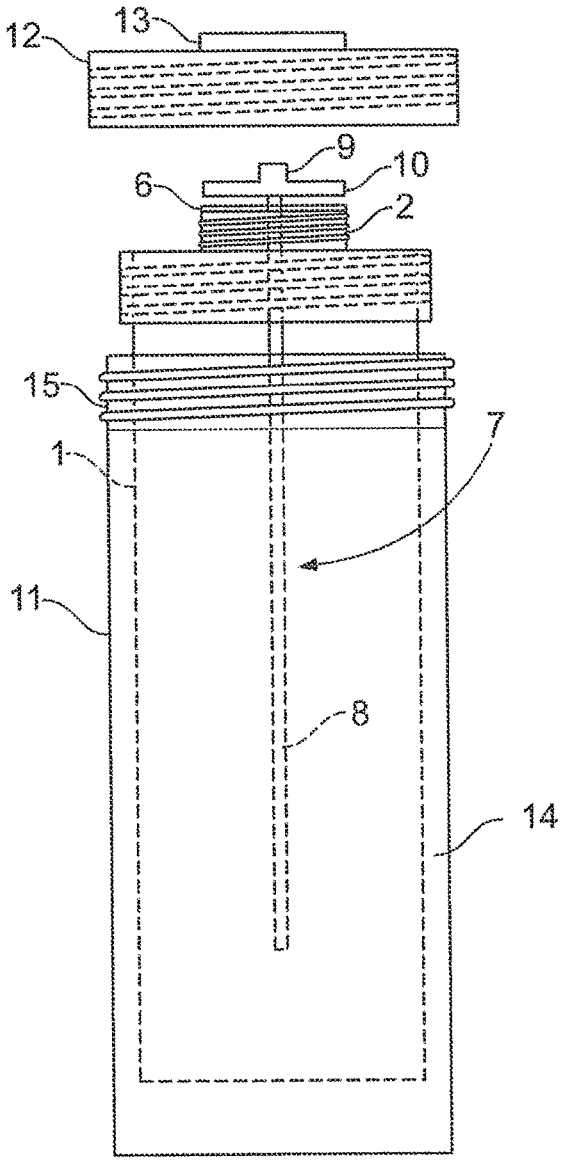
FIG. 2 is a schematic representation of the disposable container inside the rigid container of my invention.

As illustrated in FIG. 2, valve assembly 7 comprises a dip tube 8, a mounting flange 10 and a fitting 9. In use, the cap 2, with small cap 4 in place, is removed from connector 3 on disposable contain 1 and a additional liquid that is to be sprayed/atomized is placed into volume 5, which preferably already contains a base paint formulation when it was manufactured and shipped from the supplier to the retail store. Once the additional liquids or in some cases powders are added to the volume 5, then cap 2 is attached through connector 3 forming a pressure seal. The liquid filled disposable container 1 is then placed within rigid container 11. Alternatively, the disposable container could be placed within the rigid container before adding the final ingredients, such as tints, dispersions, etc. into the disposable container 1. Rigid container 11 is any shaped can or vessel that will accept disposable container 1 and will provided support, containment, and dimensional stability when the interior volume 5 of container 1 is pressurized. Preferably, the rigid container is made of metal, such as aluminum, and the interior volume 14 is of sufficient size such that all of container 1 and cap 2 will fit within the rigid container 11 and will allow rigid cap 12 to be connected through connector 15, shown in FIG. 2 as a screw thread, however, any type of connector could be used. The rigid container 11 should be designed or selected such that the disposable container 1 fits snuggly within the rigid container 11 and so that upon pressurization of the interior volume or cavity 5 of the disposable container, the plastic will not expand (or blow-up) to an extent that it would rupture and lose pressure. In essence, the rigid container should act as a supporting skin for the disposable container to allow the disposable container to be pressurized to 100 psig or more with rupturing.

Once container 1 is placed within rigid container 11, and before the rigid cap is attached, the small cap 4 can then be removed and valve assembly 7 inserted through orifice 6 such that flange 10 forms a seal with the orifice opening. To maintain a pressure seal between the flange 10 and the orifice 6, rigid cap 12 is configured with opening 13 such that when cap 12 is attached to rigid container 11, cap 12 exerts a downward compressive force on flange 10 to form a pressure seal with the orifice 6 opening. Opening 13 is configured to allow fitting 9 to be accessible when cap 12 is attached to container 11, yet still allows rigid cap 12 to exert the compressive force on flange 10.

Figure 3:
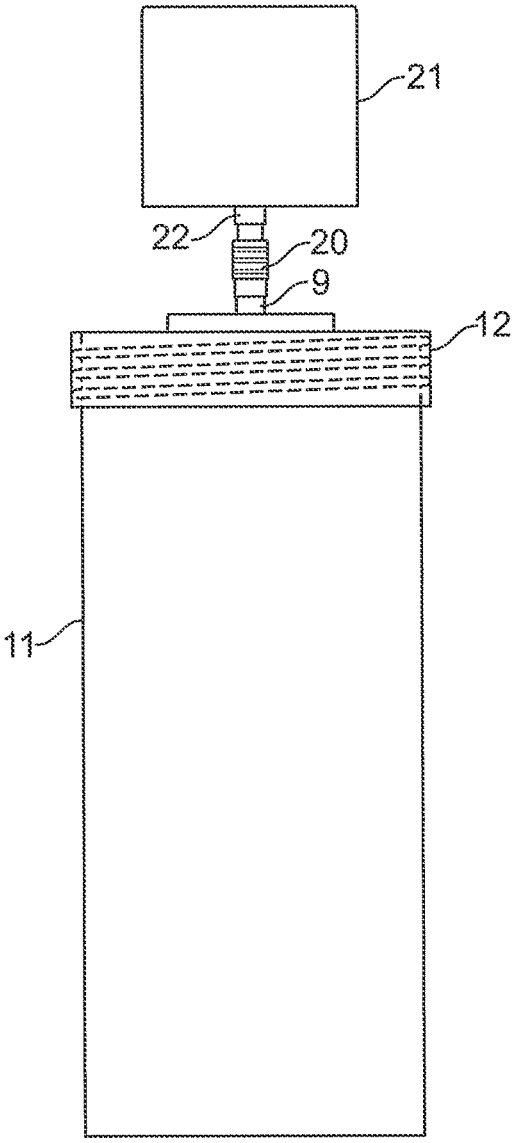
FIG. 3 is a schematic representation of my invention showing the disposable container inside the rigid container and connected to the charge can through a coupler.

With rigid cap 12 in place and the valve assembly 7 sealed to disposable container 1, a charge can 21 can be connected directly to fitting 9 or, as shown in FIG. 3, through the use of a coupler 20. Coupler 20 would contain fittings at each end for connecting and allowing fluid communication with both the charge can 21 and the valve assembly 7. Charge can 21 likewise has an exit fitting 22 that may mate/connect to one end of the coupler 20 or directly to fitting 9 of valve assembly 7. Any type of fittings can be used provided the type selected allows for transfer of a pressurized fluid between the charge can and the interior volume 5 of the disposable container 1 through valve assembly 7. In a preferred embodiment the fittings are selected so that they are specifically keyed to each other and will not attach/connect to another manufacturer's fitting. In this way the charge can (or charge can and coupler) from one manufacturer/supplier cannot be inadvertently connected/attached to the valve assembly from another manufacturer/supplier.

The charge can 21 can be pre-filled by a manufacturer with a specific type of propellant that is compatible with the specific type of liquid contained in the disposable container 1. The charge can is also pressurized to above 50 psig, preferably above 100 psig, by introducing compressed air, nitrogen, carbon dioxide, or other relatively inert gas or mixtures of gases. Charging of the charge can 21 with pressure and a propellant could be performed by the manufacturer of the charge can or also be performed at a point of sale location. For example, if the liquid in a 10 oz. disposable container 1 was a solvent based paint base, then approximately 2.5 oz. of dimethyl ether propellant could be added (charged) to the charge and then pressurized to 100 psig with compressed air. In addition to the propellant and pressurized gas, other ingredients could be added, such as a catalyst formulation that allows, for example, quick drying of a sprayed paint mixture. Such catalyst formulations could include any component which accelerates a chemical reaction between two or more other components, for example metal salts and poly-isocyanate resins. These catalysts can accelerate drying of the final spray product and/or cause a reaction to start as in the case of an epoxy. Other compounds could be added to the charge can, such a gloss formulations, polyesters, gel coats, acrylics, and polyurethane. Paint types include acrylic lacquer, acrylic enamel, acrylic urethane and water-based, more simply referred to as lacquers, enamels, urethanes and water-based.

With the final formulation of liquid now inside volume 5 of the disposable container 1, the charge can 21 is connected to fitting 9 of the valve assembly 7 (see FIG. 3). Because the pressure in the charge can is much greater than the atmospheric pressure of volume 5, the contents of charge can 21 is forced into volume 5 to mix with the liquid initially present. This forms a homogeneous mixture. The transfer can be automatic upon connection of the fittings or there could be an optional valve (not shown) to activate after the fittings are connected. In either case the transfer of the components in charge can 21 is very fast. Optionally a pressure gauge (not shown) could be associated with the charge can and one or more check valves such that the user could visibly see that the transfer occurred.

Figure 4:
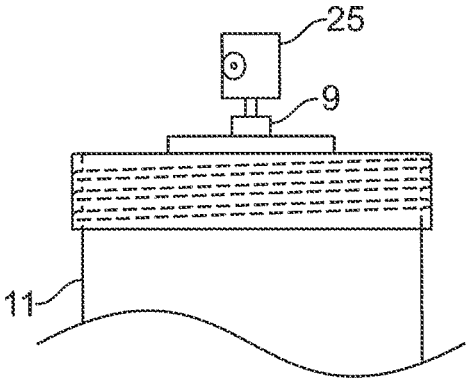
FIG. 4 is a partial view of the complete system of my invention with a spray head attached to the fitting on the valve assembly.

After transfer of the contents of the charge can 21 into disposable container 1, the charge can is disconnected from the fittings, removed from the system, and discarded for disposal or for re-charging and re-use with another system. A spray head 25 is attached to fitting 9 (see FIG. 4) and the system is now ready for use. Aerosol spray heads are well known and my system is easily adapted to accept known designs.

Turning next to FIG. 5, which shows an alternative embodiment of my invention where the rigid container 11 is not used. In this embodiment charge can 21 is connected through coupler 20 to fitting 9 located at the bottom of disposable container 1. Fitting 9 is in fluid communication with the internal portion or volume 5 of the disposable container such that when the charge can is connected the pressurized ingredients are transferred to the volume 5. Sealing cap 30 is configured with a center hole such that it can be place over spray head 25 and flange 10 to be connected with threads 31. Sealing cap 30 has an internal bearing surface that mates with and exerts a downward pressure on flange 10 to form a pressure seal that allows the volume 5 to pressured to at leas 50 psig. Similar to the fittings described above for the embodiment shown in FIGS. 1-4, the inlet and outlet fittings in FIG. 5 are keyed such that one of the keyed fittings comprises a connector that can only engage a corresponding connector on the other keyed fitting.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

The invention claimed is:

1. A spray system for liquids comprising, in combination, a) an outer rigid container having an upper end and a lower end, where a first valve assembly is located on the lower end and has a female fitting of non-standard design;

b) a rigid cap configured for removable connection to the upper end of the rigid container;

c) a disposable container positioned inside the outer rigid container and having an upper end, lower end, and an interior cavity, where the lower end has an inlet fitting that is in fluid communication with the interior cavity, where the disposable container is constructed of a material such that the interior cavity can withstand an internal pressure of at least 80 psig and contains a paint base;

d) a sealing cap configured for removable connection to the upper end of the disposable container and containing a bearing surface;

e) a second valve assembly comprising a fitting, a flange and a dip tube sealing connected to the disposable container such that the dip tube is within the interior cavity, where the flange is configured to form a seal with the bearing surface of the sealing cap;

f) a charge can comprising an outlet fitting configured to be used only with the outer rigid container, where the outlet fitting is a male fitting keyed to only fit the female fitting to allow fluid communication with the first valve assembly and the inlet fitting, where the charge can contains a propellant and a catalyst and is pressurized to greater than 80 psig; and g) a coupler attachable to the lower end of the outer rigid container and simultaneously to the charge can such when the coupler is attached the propellant and catalyst is transferred into the interior cavity.

* * * * *